US009138111B2

(12) United States Patent
Crudge et al.

(10) Patent No.: US 9,138,111 B2
(45) Date of Patent: Sep. 22, 2015

(54) DISPENSING CONTAINERS FOR WIPE ARTICLES

(71) Applicant: Reckitt Benckiser LLC, Parsippany, NJ (US)

(72) Inventors: Andrew Dennis Crudge, Ho-Ho-Kus, NJ (US); Jesse Del Gigante, Montvale, NJ (US); Christopher Michael Evans, Hoboken, NJ (US); Christopher Leonard Padain, Henley on Thames (GB)

(73) Assignee: Reckitt Benckiser LLC, Parsippany, NJ (US)

( * ) Notice: Subject to any disclaimer, the term of this patent is extended or adjusted under 35 U.S.C. 154(b) by 0 days.

(21) Appl. No.: 14/357,298

(22) PCT Filed: Nov. 20, 2012

(86) PCT No.: PCT/GB2012/052865

§ 371 (c)(1),
(2) Date: May 9, 2014

(87) PCT Pub. No.: WO2013/076467

PCT Pub. Date: May 30, 2013

(65) Prior Publication Data

US 2014/0367400 A1 Dec. 18, 2014

(30) Foreign Application Priority Data

Nov. 21, 2011 (GB) ..... 1120050.8

(51) Int. Cl.

| | |
|---|---|
| ***A47K 10/38*** | (2006.01) |
| ***B65D 83/08*** | (2006.01) |
| ***B65D 47/08*** | (2006.01) |
| *A47K 10/32* | (2006.01) |

(52) U.S. Cl.

CPC ..... *A47K 10/38* (2013.01); *A47K 10/3818* (2013.01); *B65D 47/0804* (2013.01); *B65D 83/0805* (2013.01); *A47K 2010/3266* (2013.01)

(58) Field of Classification Search

CPC ..... A47K 10/38
USPC ..... 221/45, 47, 55, 63
See application file for complete search history.

(56) References Cited

U.S. PATENT DOCUMENTS

| | | | | |
|---|---|---|---|---|
| 3,843,017 | A * | 10/1974 | Harrison | 221/63 |
| 4,353,480 | A * | 10/1982 | McFadyen | 221/63 |
| 4,462,507 | A * | 7/1984 | Margulies | 221/63 |
| 6,766,919 | B2 * | 7/2004 | Huang et al. | 221/63 |
| 7,216,775 | B2 * | 5/2007 | Evans et al. | 221/63 |

(Continued)

OTHER PUBLICATIONS

Notification of Transmittal of the International Search Report and the Written Opinion of the International Searching Authority for PCT/GB2012/052865 dated Sep. 26, 2013.
International Search Report for PCT/GB2012/052865 dated Sep. 26, 2013.

(Continued)

*Primary Examiner* — Patrick Mackey
(74) *Attorney, Agent, or Firm* — Norris McLaughlin & Marcus PA

(57) ABSTRACT

Disclosed is a dispensing cap adapted to be removably, or permanently affixed to a container comprising a plurality of interconnected individual wipes, which dispensing cap includes a partly stationary and partly moveable plate having a dispensing orifice a portion being defined by a stationary plate part, a further portion of the dispensing orifice being defined by a moveable plate part.

6 Claims, 10 Drawing Sheets

(56) References Cited

U.S. PATENT DOCUMENTS

| | | | | |
|---|---|---|---|---|
| 2005/0236416 | A1* | 10/2005 | Reinke et al. | 221/63 |
| 2011/0011876 | A1* | 1/2011 | Baer | 221/1 |
| 2011/0011878 | A1* | 1/2011 | Baer et al. | 221/45 |

OTHER PUBLICATIONS

Written Opinion of the International Searching Authority for PCT/GB2012/052865 dated Sep. 26, 2013.

* cited by examiner

Fig. P1
Prior Art
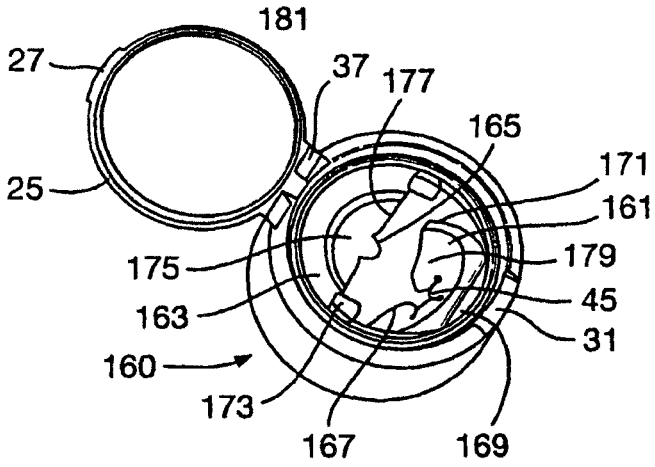
Fig. P2
Prior Art
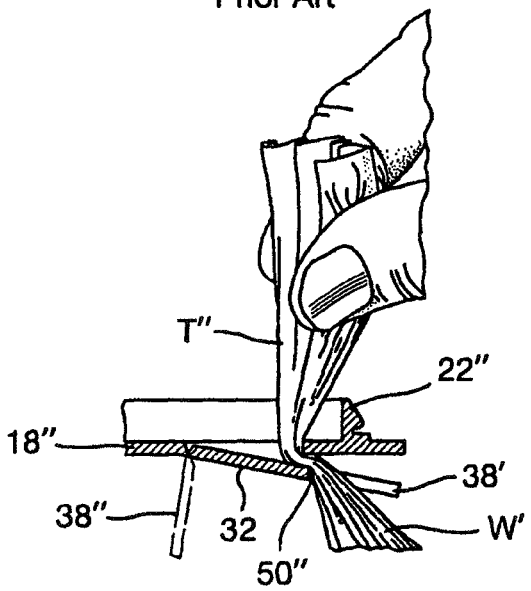

DISPENSING CONTAINERS FOR WIPE ARTICLES

This is an application filed under 35 USC 371 of PCT/GB2012/052865, filed 20, Nov. 2012, which in turn claims the priority benefit of GB 1120050.8 filed 21, Nov. 2011.

Long since known to the art are cleaning articles which are preimpregnated fibrous substrates, also commonly referred to as "wipes". Such wipes are preimpregnated with one of a variety of surface treatment compositions which are tailored towards a specific use, or may ultimately have a composition which is useful in the treatment of different types of surfaces. For example, certain types of wipes may be specifically adapted for the treatment of polished surfaces, such as furniture, wood surfaces, and the like, while other types of wipes may provide a broader range of treatment options, such as an all-purpose treatment composition which may provide a cleaning benefit, and optionally an antimicrobial benefit to surfaces being treated with such wipes. Typically, such wipes are provided in a package or in a dispensing container. In such packages or dispensing containers the wipes are typically provided either as a stack of individual sheets (which may optionally be separated, but can be still interconnected by perforations between each sheet) which are withdrawn and used by a consumer, or are provided in a continuous roll of a plurality of individual sheets which are typically held together by perforations. The latter format of wipes are particularly popular as a large number of individual wipes can be provided within a dispensing container. Also, typically due to the fact that the plurality wipes are provided on a continuous roll or web with individual wipes being separable from the next adjacent wipe along the line of perforations, the dispensing container are typically cylindrical in nature. Such dispensing containers usually comprise two parts, a container part which houses the roll of wipes, having affixed at one end thereof a dispensing cap which provides dual functions of sealing the container between dispensing operations, as well as providing a dispensing means whereby wipes can be withdrawn from the roll and separated from the next adjacent wipe by a consumer. Advantageously, such dispensing means also provides for retention of the next wipe to be withdrawn from the container, after the wipe has been separated by a consumer. Such a feature is important as, normally, prior to the first use of a wipe, a consumer is required to first extract the innermost wipe sheet from within the interior of the roll of preimpregnated wipes and drag it outwardly such that the wipe interacts with one or more elements of the dispensing means. The dispensing means ideally functions to both provide a convenient means for withdrawing a wipe and for separating a first wipe (or sheet) from a next wipe (or sheet) from the roll after the first wipe has been substantially withdrawn from the dispensing means, and, after separation the first wipe from the next (and remaining) wipes of the roll, retaining, i.e., gripping, a part of the next wipe within a part of the dispensing means whereby can be readily grasped by the consumer and drawn out from the container and the dispensing means when desired by the consumer. One technical problem in the art is to avoid "fall-back", or namely, wherein after a wipe is withdrawn and dispensed, that the next wipe is not retained by the dispensing means or part thereof, and literally, the next wipe falls back into the interior of the container. Such is inconvenient for a consumer who then is required to rethread the wipes from within the container into the dispensing means. Another technical problem which needs to be satisfactorily addressed is to avoid difficulties in separation of wipes when being dispensed due to "roping". Roping is an undesired, but characteristic behavior of the moist and preimpregnated wipes being withdrawn from the container particularly when such are provided in a cylindrical roll, wherein the wipes are dispensed from the interior of the roll. As can be appreciated, the wipes or sheets are moist due to the presence of the preimpregnated treatment composition, and typically exhibit a significant degree of surface drag such that as they are drawn outwardly from the center of the roll, wipes will tend to form spirally wound configurations or "ropes" which are difficult to separate from the next adjacent wipe on the roll. This phenomenon is most prevalent when a roll of wipes is initially dispensed, but as the roll is exhausted due to the withdrawal of successive individual wipes, this problem diminishes. However, a new problem arises in that, as the interior cavity or the "empty diameter" of the roll increases the orientation of the individual wipes being dispensed also varies along the geometry of the circular empty diameter of the roll of wipes; and thus, a dispensing means in order to be successful, should also compensate for, or be tolerant of, multidirectional delivery or orientation of a wipe being withdrawn and separated off the roll as it passes through the any dispensing means. This is due to the fact as wipes are withdrawn from the interior of the roll, they are unspooled and their radial direction changes with respect to the dispensing means, which in turn varies the tension required by a consumer to withdraw an individual wipe through such dispensing means. Such a problem is particularly prevalent when the roll (or spool) of wipes is nearly exhausted, and the inner diameter of the interior cavity of the roll is near its maximum value, e.g., when few wipes remain on the roll. Further, ideally, the construction or configuration of a dispensing means should also be one which provides a useful barrier to either volatile or of evaporable components within the composition used impregnate the wipes. Although a dispensing container and/or its dispensing means may include an overcap or a cap (or other element) for sealing its contents from the ambient environment between dispensing operations, nonetheless the consumer's consistent use of such caps or other elements is not to be completely relied upon. Frequently such a cap may be easily but inadvertently opened, or for that matter, a consumer may fail to properly seal such a cap other element, either of which permits for volatile or of evaporable components to escape the roll of wipes and enter the environment, which reduces the treatment efficacy of the wipes. Therefore, it should be understood that while many dispensing means may appear to be simplistic to the uninitiated, yet there nonetheless exist a plurality of technical problems, some of them subtle to appreciate, which still need to be fully and successfully addressed.

Various dispensing containers have been proposed in the art, and are known. For example, one such container is that disclosed in U.S. Pat. No. 3,843,017. Therein is disclosed a dispenser adapted for dispensing a treated perforated tissue web wherein it is provided with an opening for extracting the web from the dispenser, said opening having associated therewith and interior flap which normally closes the opening through which the web is withdrawn, thereby providing sufficient tension on the web to cause it to tear off at the perforations. In one embodiment, the dispenser includes a flap which is sized such that it completely closes and overlaps the opening of the dispenser thereby forcing the web to travel in a torturous path. A further dispensing container is known from U.S. Pat. No. 7,216,775. Therein are disclosed dispensing containers which permit for the initial threading of a wipe from a roll of wipes which does not require the withdrawal of the dispensing cap but rather, permits for the user or consumer to grasp the first wipe, and pull it outwardly from the roll and threaded through portions of the dispensing container. The dispensing container also includes, and embodiment were a single "flap" includes a dispensing orifice wherein the dispensing orifice is at the base of a concave portion of the dispensing container.

Neither of these foregoing dispensing containers is without shortcomings however. It is expected that the dispensing container according to U.S. Pat. No. 3,843,017 would require varying and inconsistent degrees of tension to be imparted to wipes being withdrawn due to the multidirectional delivery or orientation of an individual wipe being unrolled from (or, unspooled from the roll) and separated off the roll as it passes through the dispensing means. Namely, there would be a significant amount of force required by the user to withdraw a wipe and separate it from the roll of wipes depending upon the relative orientation of the wipe being withdrawn from (or unspooled from) the roll within the container, and the flap and orifice of U.S. Pat. No. 3,843,017. The dispensing container of U.S. Pat. No. 7,216,775 in all embodiments, necessarily includes a concavity in its construction, at the lowest point of which is necessarily placed a dispensing orifice which may include a plurality of lobes. The dispensing orifice is also configured, in all embodiments, to be necessarily at the center of the dispensing cap provided in U.S. Pat. No. 7,216,775, which also ensures that the roll of wipes is also essentially concentric with the dispensing orifice. The arrangement provides a benefit in that the placement of the dispensing orifice is coaxial with the central axis or center of the roll of dispensing wipes which wipes are also dispensed first from the interior of said roll, which configuration maintains a more consistent tension which needs to be imparted to successive wipes being withdrawn due to the multidirectional delivery or orientation of a wipe being withdrawn and separated off the roll as it passes through the any dispensing means. However, this arrangement is also poorly adapted to overcome the problem of "roping" as described above, in that the sole frictional force imparted by the dispensing container upon the wipes being unspooled from the interior of the roll of wipes via the dispensing orifice is that imparted by the lobes of the dispensing orifice themselves and only by these lobes. Such as undesirable as it makes wipes particular difficult to separate from a next successive wipe and also frequently allows for a plurality of wipes, as opposed to a single wipe, to be dispensed contrary to a consumer's expectations. Further, the dispensing container of U.S. Pat. No. 7,216,775 in all embodiments necessarily includes a concavity in its construction, and part of the dispensing container pivots about a "living hinge" adjacent to the interior circular rim of the dispensing cap along a short chord; this arrangement and the concavity of the moveable element necessarily increases the overall height of the movable element as it is swung down to a generally vertical orientation necessary in order to permit access to the interior of the container such that the user can grasp and initially withdraw a wipe from the interior of the roll of wipes. This may in certain cases be undesirable in that it requires either a shorter heights to the roll of wipes, or a taller container in order to accommodate this requirement of the dispensing orifice to sufficient clearance presents to permit for the movable element to rotate.

As we seen from the foregoing discussion, while the prior art does provide some useful dispensing means and article, the nonetheless remains a real and containing need for further improvements in this technical field. It is to addressing these shortcomings, as well as others, that the present invention is directed.

In a first aspect the present invention is directed towards a dispensing cap adapted to be removably, or permanently affixed to a container which container contains a plurality of individual wipes interconnected to one another but separable along one or more perforations between individual wipes, which dispensing cap includes a partly stationary and partly moveable plate having a dispensing orifice which is offset from the center part of the dispensing cap, said dispensing orifice being surrounded by a plurality of individual flexible lobes, a portion of the dispensing orifice being defined by the stationary plate part, a further portion of the dispensing orifice being defined by a moveable hinged plate part of the dispensing orifice which is moveable along a hinge line from which the hinged plate part depends from a part of the stationary plate, and further wherein the hinged plate part includes a depending brace wall which extends downwardly from the hinged plate part from the underside thereof, which brace wall is located at or near the periphery of the said remaining portion of the dispensing orifice present on the hinged plate part.

In a second aspect, the present invention is directed towards a dispensing cap as described with reference to the first aspect, which dispensing cap further includes a top closure cap.

In a third aspect, the present invention is directed towards a dispensing container, which dispensing container includes a dispensing cap as described above with reference to the first or second aspects, a container, and a plurality of individual wipes provided as a continuous linear roll of preimpregnated wipes separable from one another along one or more perforations present between individual wipes.

In a fourth aspect, the present invention is directed towards an improved method of dispensing one or more cleaning wipes from a dispensing container, which method includes the steps of providing a dispensing container having dispensing cap, container and plurality of wipes as described with reference to any of the foregoing aspects of the invention.

These and further aspects as well as features of the invention will be understood from the following specification, when considered along with the accompanying referenced figures.

FIG. P1 depicts a perspective view of a prior art dispensing cap according to U.S. Pat. No. 7,216,755.

FIG. P2 depicts in a cross-sectional view, portion of the prior art dispensing cap according to U.S. Pat. No. 3,843,017.

Figure 6:
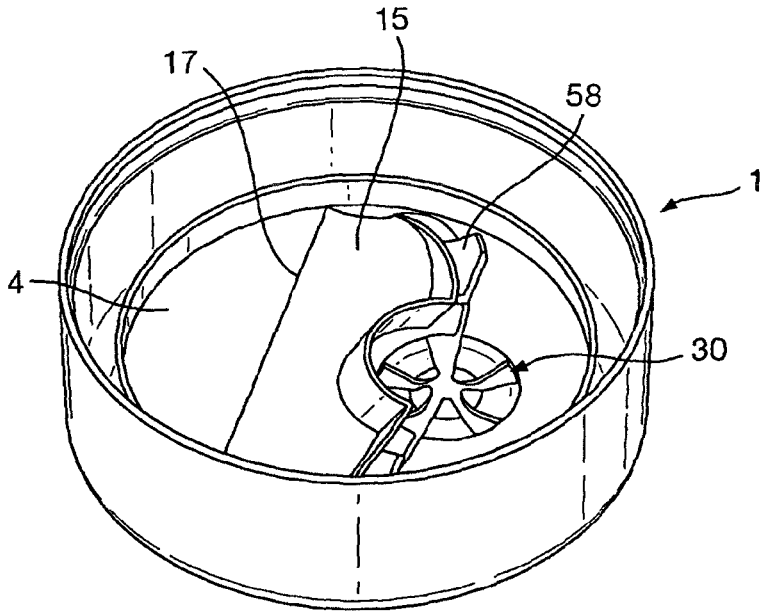
FIG. 6 depicts in a perspective view, the bottom of a portion of the dispensing cap according to FIG. 1.
Figure 7:
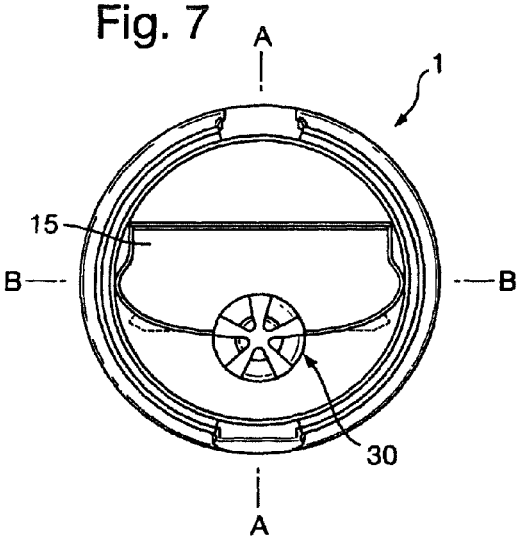
FIG. 7 depicts in a top plan view a second embodiment of a dispensing cap according to the present invention.
Figure 8:
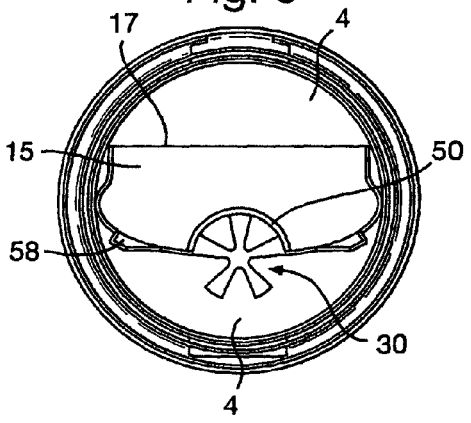
FIG. 8 depicts in a bottom plan view the dispensing cap according to FIG. 7.
Figure 9:
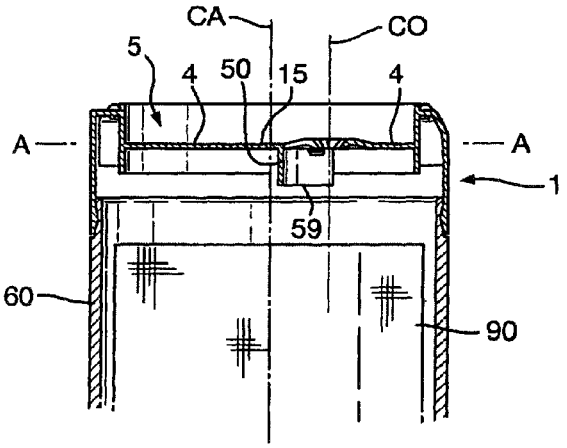
FIG. 9 depicts in an elevational view, a cross-section of dispensing cap according to FIGS. 7 and 8 mounted upon a container, a part of the container being visible and containing a continuous roll of wipes.
Figure 10:
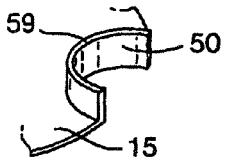

FIG. 10 a detail of a portion of the dispensing cap of FIGS. 7, 8 and 9. FIG. 6 depicts in a perspective view, the bottom of a portion of the dispensing cap according to FIG. 7.

Figure 11:
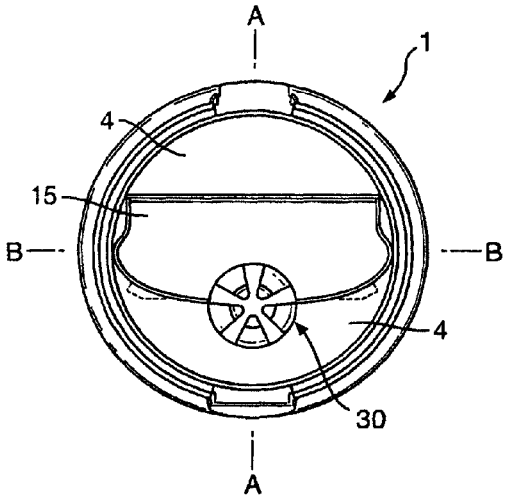

FIG. 11 depicts in a top plan view a third embodiment of a dispensing cap according to the present invention.

Figure 12:
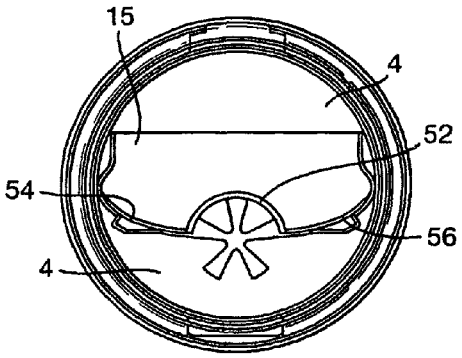

FIG. 12 depicts in a bottom plan view of the portion of the dispensing cap according to FIG. 11.

Figure 13:
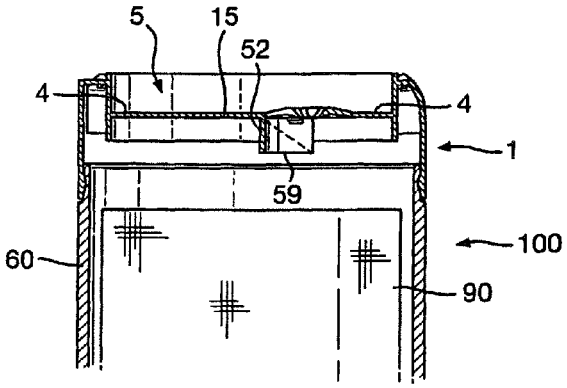

FIG. 13 depicts in an elevational view, a cross-section of dispensing cap according to FIGS. 11 and 12 mounted upon a container, a part of the container being visible and containing a continuous roll of wipes.

Figure 14:
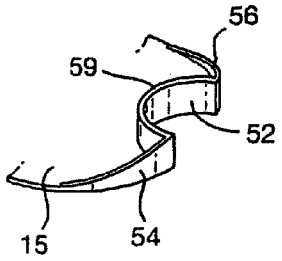

FIG. 14 a detail of a portion of the dispensing cap of FIGS. 11, 12, and 13.

Figure 15:
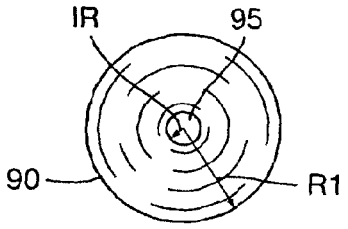

FIG. 15 illustrates a top view of the end of a roll of wipes, prior to the withdrawal of a first wipe from the roll.

Figure 16:
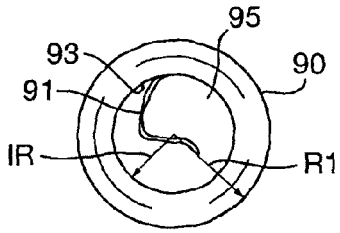

FIG. 16 illustrates a top view of the roll of wipes of FIG. 15, wherein approximately one-half of the individual wipes have been previously withdrawn and separated from the roll.

Figure 17:
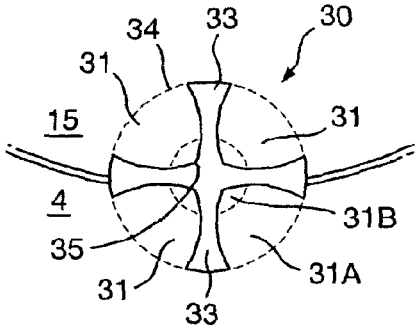

FIG. 17 illustrates a detailed view of a first embodiment of a dispensing orifice with a plurality of surrounding lobes.

Figure 18:
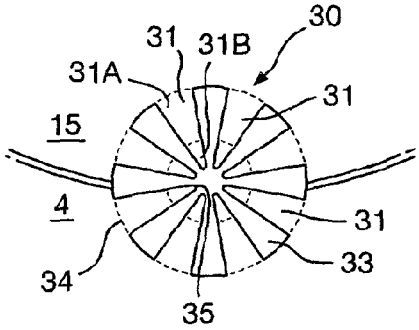

FIG. 18 illustrates a detailed view of one embodiment of a dispensing orifice with a plurality of surrounding lobes.

Figure 19:
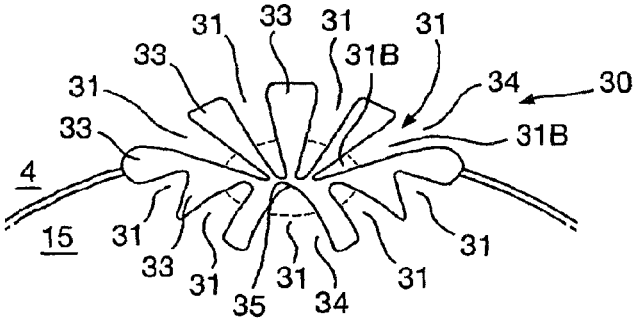

FIG. 19 illustrates a detailed view of an alternate embodiment of a dispensing orifice with a plurality of surrounding lobes.

Figure 1:
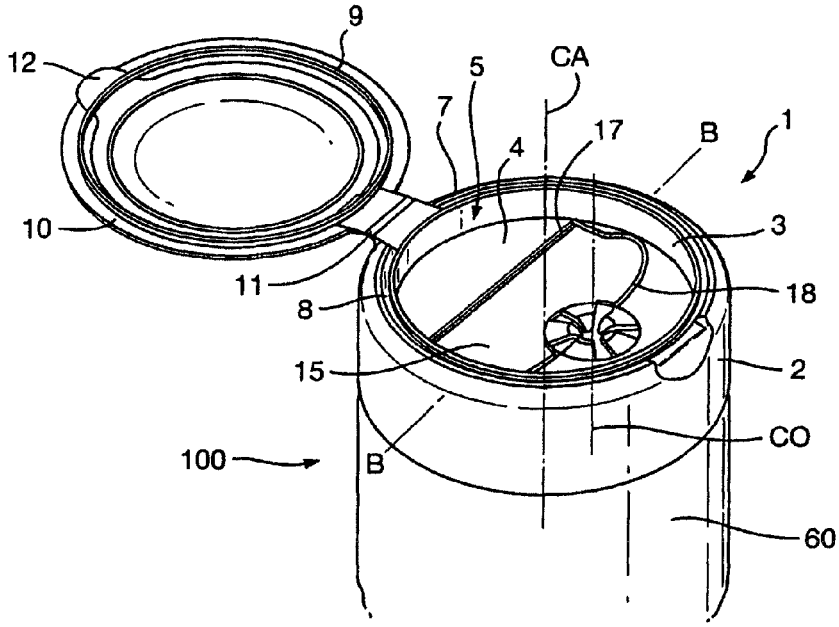
FIG. 1 depicts in a perspective view a first embodiment of a dispensing cap according to the present invention.
Figure 2:
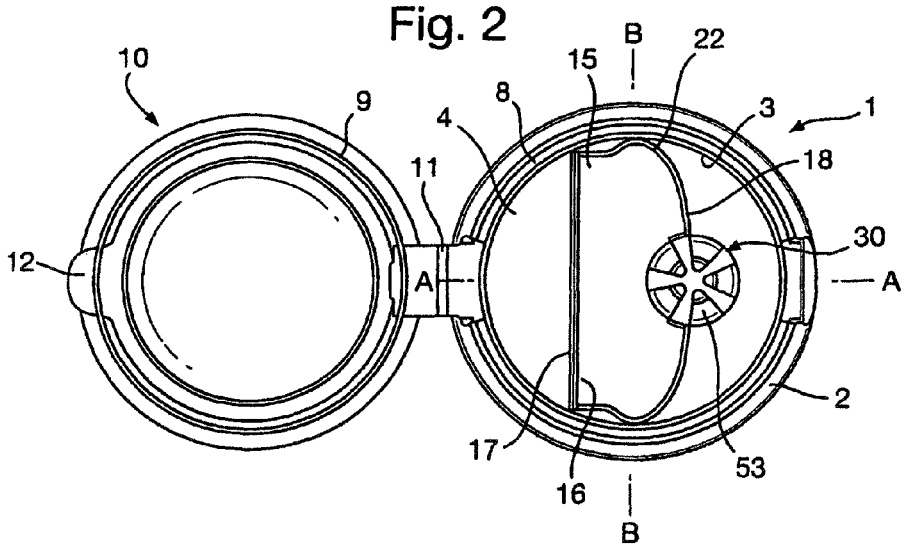
FIG. 2 depicts in a top plan view a dispensing cap according to FIG. 1.
Figure 20A:
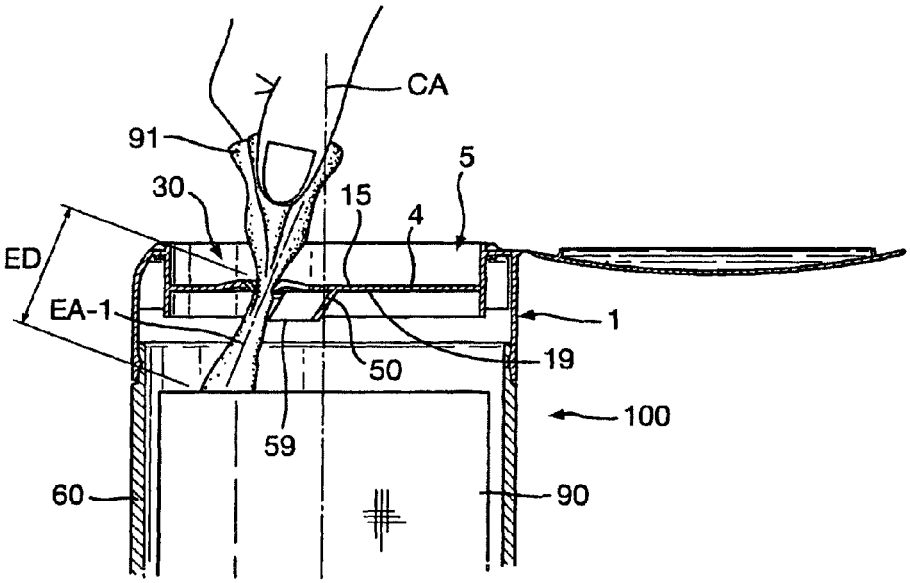

FIG. 20A depicts in an elevational view, a cross-section of dispensing cap according to FIG. 1 mounted upon a container, and further illustrating a continuous roll of wipes within the container, with one of the wipes being partially withdrawn from the roll and part of said wipe been retained by the surrounding lobes of the dispensing orifice, illustrating a first relative radial orientation of the wipe with respect to the roll of wipes and further with respect to the position of the dispensing orifice.

Figure 20B:
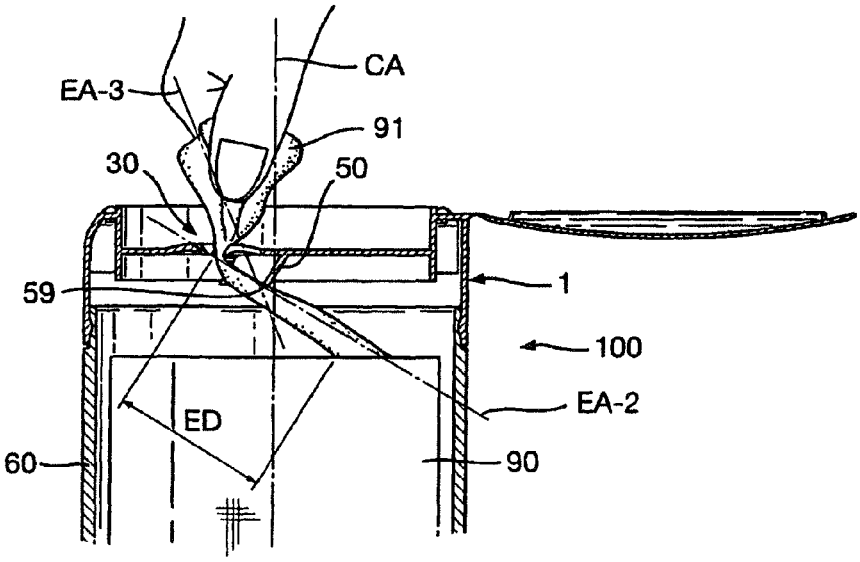

FIG. 20B depicts in an elevational view, a cross-section of dispensing cap according to FIG. 1 mounted upon a container, and further illustrating a continuous roll of wipes within the container, with one of the wipes being partially withdrawn from the roll and part of said wipe been retained by the surrounding lobes of the dispensing orifice, and wherein the said wipe is oriented in an alternate orientation than that depicted on FIG. 26A.

Figure 21A:
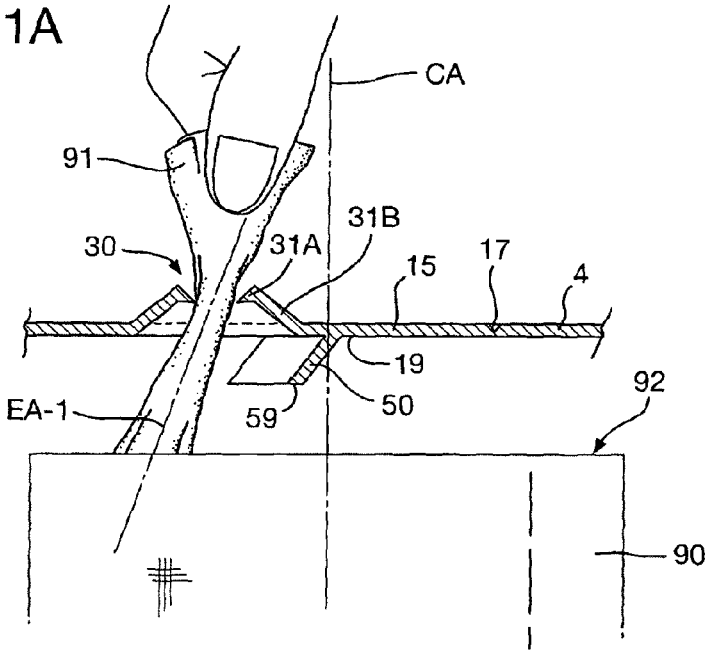

FIG. 21A depicts in a cross-sectional view, a portion of a dispensing illustrating in more detail the manner in which an individual wipe is withdrawn through the dispensing orifice, which figure corresponds to the orientation of the roll of wipes, the individual wipe being withdrawn, and the dispensing orifice and the dispensing cap as depicted on FIG. 20A.

Figure 21B:
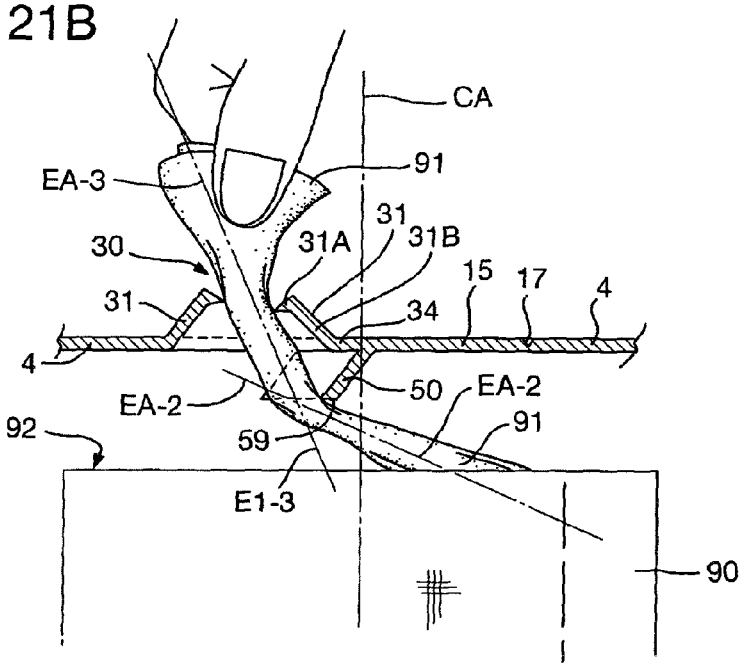

FIG. 21B depicts in a cross-sectional view, a portion of a dispensing illustrating in more detail the manner in which an individual wipe is withdrawn through the dispensing orifice, which figure corresponds to the orientation of the roll of wipes, the individual wipe being withdrawn, and the dispensing orifice and the dispensing cap as depicted on FIG. 20B.

Figure 22:
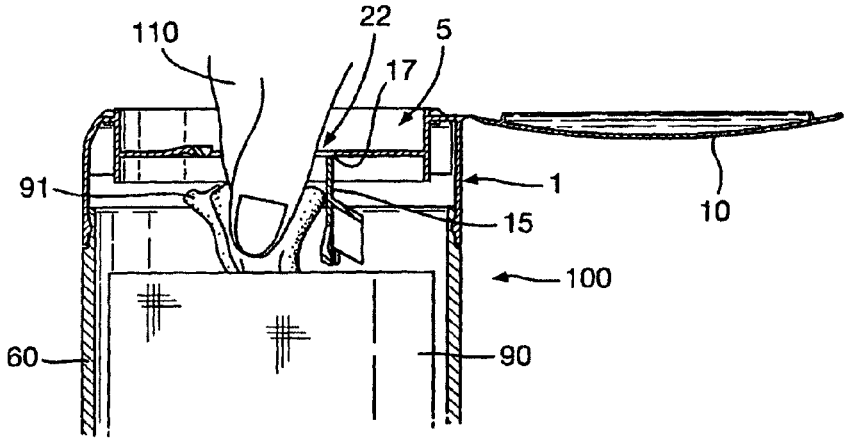

FIG. 22 depicts in a cross-sectional view, a portion of a dispensing cap according to the present invention illustrating the manner in which an individual wipe may be initially withdrawn through the dispensing cap from within the container containing a roll of wipes, wherein the hinged plate part is in an "open position".

Figure 23:
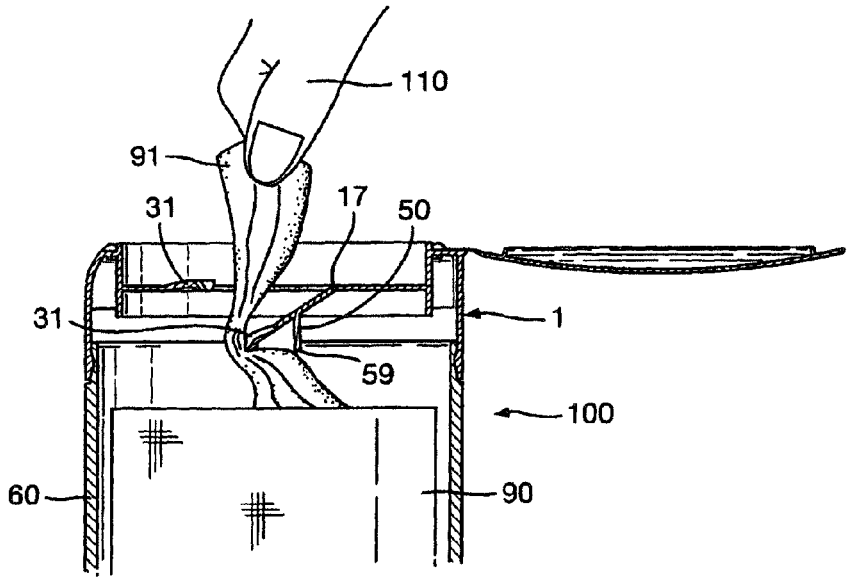

FIG. 23 depicts in a cross-sectional view, a portion of a dispensing cap according to the present invention illustrating the manner in which an individual wipe withdrawn through the dispensing cap engages with a part of the dispensing cap, wherein the hinged plate part is in a "partially open position".

In the figures, like elements or parts are provided with like reference numbers.

FIGS. 1-6 illustrate various views a first embodiment of a dispensing cap 1 according to the invention. In the embodiment shown, the dispensing cap comprises an outer peripheral sidewall 2 which in this embodiment is shown to be generally circular, an inner peripheral sidewall 3 which is spaced apart from the outer peripheral sidewall 2, and a stationary plate 4 spanning the space defined by and between the inner peripheral sidewall 3. A top cavity 5 is present within the dispensing cap 1, and is present between the plate 5 and a top surface 7 of the dispensing cap 7 spans between the inner peripheral sidewall 3 and the outer peripheral sidewall 2 and in the embodiment shown, this top surface 7 includes a generally circular recess 8 which is adapted to accommodate a sealing bead 9 which depends from a top closure cap 10 which is pivotally connected by means of a hinge element 11 with a part of either the outer peripheral sidewall 2, the top surface 7, or the inner peripheral sidewall 3 of the dispensing cap. Without being illustrated in specific detail, but which can nonetheless be understood from FIG. 1., the dispensing cap is mounted upon a container 60 (partly depicted) within which container is provided a roll of wipes (not shown), especially a roll of preimpregnated wipes which are separable from one another by one or more perforations present therebetween. The top closure cap 10, as illustrated in the figures, is suitably dimensioned in order to provide a removable cover whereby at least the plate 4 can be sealed from the exterior environment by moving the top closure cap 10 such that the sealing bead 9 engages the recess 8 in a friction fit, but preferably forms a substantially liquid tight or vapor tight type seal. Such a seal advantageously diminishes, or halts, passage of any evaporated or evaporable liquids from within the interior of the container 60, past the plate 4 and to the surrounding environment. When properly used, the top closure 10 diminishes the premature drying out of, such as by evaporation, of any liquid used to impregnate one or more of the wipes within the container 60. Advantageously, as further shown in FIGS. 1 and 2, the top closure 10 also includes a grip tab 12 which may be used to facilitate the opening or release of the top closure 10 from the top surface 7 of the dispensing cap when desired by a user or consumer to withdraw a wipe from the roll of wipes 90 within the dispensing container 100.

Figure 3:
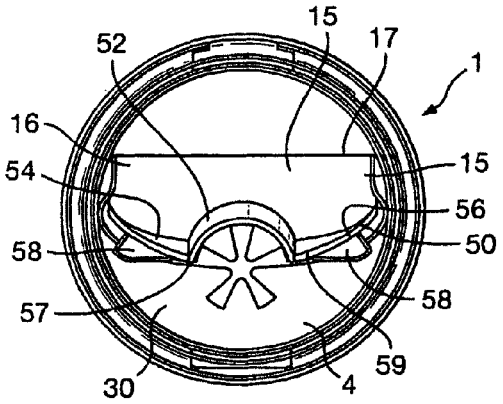
FIG. 3 depicts in a bottom plan view a portion of the dispensing cap according to FIG. 1.
Figure 4:
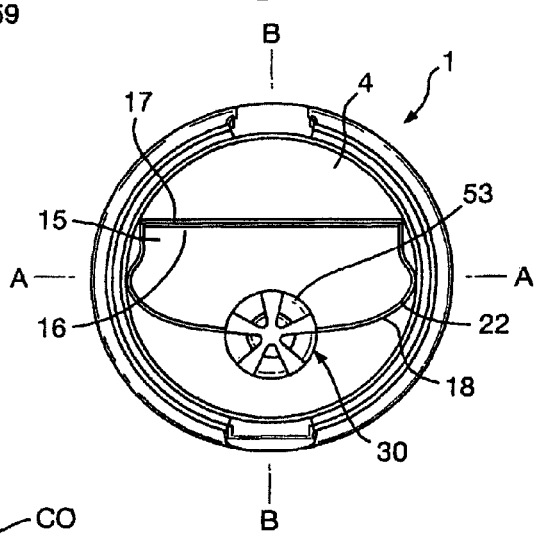
FIG. 4 depicts a top plan view a portion of the dispensing cap according to FIG. 1.
Figure 5:
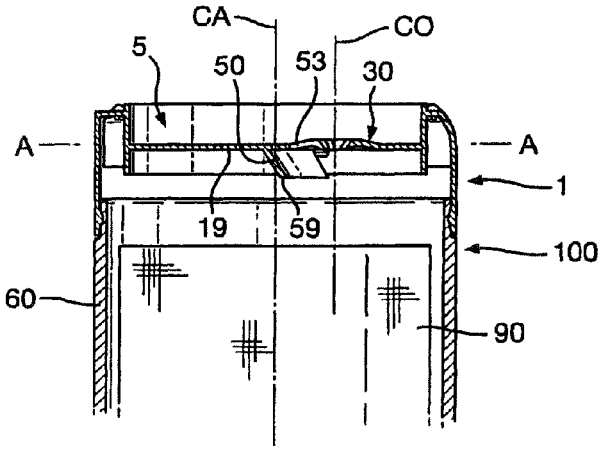
FIG. 5 depicts in an elevational view, a cross-section of dispensing cap according to FIG. 1 mounted upon a part of container, and further illustrating part of a continuous roll of wipes with in the container.

As described, the dispensing cap includes a plate 4 which depends from, and spans the space defined by the inner peripheral sidewall 3. Part of this plate 4 is stationary. In the depicted embodiment the shape of the dispensing cap as well as the inner peripheral sidewall 3 are both circular, concentric around a common axis, which is referred to as "CA" in the drawing figures. Also depicted are further reference lines, a first reference line "A" which passes through the plate 4, and is perpendicular to the common axis CA, and a second reference line "B" which also passes through the plate 4, and is perpendicular to both reference line A and common axis CA. Now with reference particularly to FIGS. 2 and 4, a portion of the plate 4 is a hinged plate part 15 as shown. The hinged plate part 15 includes a rear edge 16 which abuts, or forms part of a hinge 17 which allows for the hinged plate part 15 to move downwardly from the stationary plate 4 which depends from the inner peripheral sidewall 3. When installed or mounted on a container 60, the hinged plate part 15 moves downwardly or inwardly in a direction towards the interior of the container 60 and/or the direction of the roll of wipes 90. The hinged plate part 15 also includes a forward edge 18, a part of which forms the dispensing orifice 30, the remaining part of the dispensing orifice 30 being formed by part of the plate 4. As is visible from the figures, the dispensing orifice in this embodiment is also generally circular in configuration, and it is generally concentric around its own reference center axis "CO". However, as is most clearly visible from FIG. 5, the center axis "CO" is offset from the common axis CA but is parallel thereto. This offset feature of the dispensing orifice 30 is particularly pertinent in understanding one of the operating principles of the instant invention. It is also pertinent to understand that the concentric, center axis of a roll of wipes contained within the container 60 generally remains concentric around the common axis CA when wipes are being individually dispensed through the dispensing cap 1. The hinged plate part 15, apart from the portions which are used to define a part of the dispensing orifice 30, is preferably generally flat or planar, and it can be moved or swung into position as shown in FIG. 1 wherein it is coincident with the plate 4. The plate 4 includes a plate opening 22 which is defined by opening through the plate 4 when the hinged plate part 15 is swung downward or inwardly along the hinge 17. The plate opening 22 defines an area wherein the interior of the container 60 and one or more of the wipes present on the roll of wipes 90 can be accessed by a consumer or user of the dispensing container 100. It is also to be observed that the hinge 17 as illustrated, is advantageously generally parallel to reference line A, and offset from the common axis CA such that the hinge 17 is on the opposite side of reference line A from the dispensing orifice 30. Such an arrangement provides for improved access to the interior of the container 60 and its contents. Such also diminishes the distance from the rear edge 16 to the front edge 18, and thus the dimension of the hinged plate part 15 which extends downwardly from the stationary plate 4 when the dispensing cap 1 is in an "open position". Such allows for the distance of from the top of a roll of wipes to the plate 4 to be reduced over many prior art devices and designs, and in particular over the dispensing container of U.S. Pat. No. 7,216,775. With reference now in particular to FIGS. 3, 5 and 6, as depicted, there is also present a depending brace wall 50 which extends downwardly from the underside 19 of the hinged plate part 15. The brace wall 50 extends in a direction inwardly towards the container 60, and is positioned at or near the periphery of the portion of the dispensing orifice 30 present on the hinged plate part 15. Regarding the embodiment illustrated on FIG. 3, the brace wall 50 includes a center region 52 at or near the periphery 53 of the portion of the dispensing orifice 15 defined by the hinged plate part 15 which is in the shape of a semicircular arc, from the ends of which extend outwardly tapering support walls 54, 56 which also depend from the forward edge 18 of the hinged plate part 15. As is now best seen from FIGS. 5 and 6, the brace wall 50 and its parts while depending from the hinged plate part 15 at one end, are also angled with respect thereto, here in an oblique angle with respect to the hinged plate part 15. The angle of this oblique is preferably not more than 90 degrees of arc, but is preferably about 60 degrees of arc, or less as illustrated in FIG. 5. Most preferably this oblique angle is in the range of from about 25-60, degrees of arc. Advantageously also, the direction of the angle is such that the top 59 of the brace wall 50 extends in the direction of the reference center axis CO of the dispensing orifice 30. As is evident from a consideration of FIGS. 3 and 6, (and as well as in the embodiment of later FIGS. 12 and 14), tapering support walls 54, 56 advantageously provide a sloped edge or sloped surface upon which, or against which, an individual wipe which is being pulling outwardly from the roll of wipes and generally in the direction of the common axis CA, may come into contact. The taper of the support walls 54, 56 provides the advantage of acting to direct the orientation of the wipe being withdrawn from the roll of wipes towards the center region 52 adjacent to the dispensing orifice 30 and to minimize snagging of an individual wipe during its withdrawal. The taper provides a smooth surface from the hinged plate part 15 to the center region 52 adjacent to or proximate to the dispensing orifice 30, which functions as a ramp for the individual wipe being withdrawn and aids in centering it or shifting it to the center region 52 and the orifice 30.

Optionally, but advantageously, the dispensing cap 1 includes one or more stop elements 58 which limits the rotation of the hinged plate part 15 respect to the plate 4. As is seen on FIGS. 3 and 6 such stop elements 58 may take the form of extended tabs which protrude outwardly from the underside of the hinged plate part 15 such that, when it is rotated about its hinge 17, the hinged plate part 15 is impeded from further direction outwardly from the plate opening 22, such that the hinged plate part 15 is maintained to be approximately coplanar or flush with the plate 4. Other stop elements, e.g. those which extend from the stationary plate 4 and which interact with the hinged plate part 15, though not particularly illustrated in the figures, are also contemplated and within the scope of the present invention.

FIGS. 7-10 illustrate a second embodiment of a dispensing container 100 according to the invention, which includes the dispensing cap 1 substantially similar in most respects to the first embodiment of the dispensing container 100 and the dispensing cap 1 previously discussed. In the second embodiment, the primary difference lies in the configuration of the brace wall 50. As is most clearly seen with respect to FIG. 8 and FIG. 10, the brace wall 50 is a semicircular arc which depends downwardly from the hinged plate part 15 at or adjacent to the periphery 53 of the portion of the dispensing orifice 30 defined by the hinged plate part 15. In this embodiment, the brace wall 50 is of a radius which is concentric with that of the reference center axis CO of the dispensing orifice 30, and further, it is approximately or is essentially perpendicular to the plate part 15, viz., does not present an oblique angle with respect to the generally planar, hinged plate part 15. This embodiment illustrates an alternative configuration of the brace wall 50 than that previously described.

FIGS. 11-14 illustrate a third embodiment of a dispensing container 100 according to the invention, which includes the dispensing cap 1 substantially similar in most respects to the first embodiment of the dispensing container 100 and dispensing cap 1 previously discussed. In this third embodiment, the primary difference present is that in the configuration of the brace wall 50. As is most clearly seen with respect to FIG. 8 and FIG. 10, the brace wall 50 along its length is approximately or is essentially perpendicular to the plate part 15. The brace wall 50 includes a center region 52 at or near the periphery 53 of the portion of the dispensing orifice 15 defined by the hinged plate part 15 which is a semicircular arc, from the ends of which extend outwardly tapering support walls 54, 56 which walls also depend from the forward edge 18 of the hinged plate part 15. in this embodiment, the center region 52 of the brace wall 50 is of a radius which is concentric with that of the reference center axis CO of the of the dispensing orifice 30. This embodiment illustrates a further configuration of the brace wall 50 than has been previously described.

FIG. 15 illustrates a top view of the end 92 of a roll of wipes 90, prior to the withdrawal of a first wipe from the roll 90. As is seen thereon, the roll of wipes 90 in this end view are circular, and comprise a plurality of individual wipes, which are attached at joining sides, which individual wipes are separable from the next adjacent wipe by one or more perforations (or like means or elements). Typically, this roll of wipes in its initial configuration includes a longitudinal central hole 95 along the center axis of the wipes, which can also be oriented along and defined by the common axis "CA" discussed previously when wipes are being individually withdrawn from the dispensing container 100. The central hole 95 has an inner radius IR, and the roll of wipes 90 has an outer radius R1. In use, a consumer removes an innermost wipe by grasping a portion of an individual wipe 91 present within, or at the periphery of this central hole 95 and while grasping the individual wipe 91, pulling outwardly from the roll 90 and generally in the direction of the common axis CA. This first wipe can be separated from the next successive wipe by pulling it apart at the perforations.

FIG. 16 illustrates a top view of the roll of wipes 90 of wherein approximately one-half of the individual wipes have been previously withdrawn and separated from the roll. This figure is useful in understanding an important advantage provided by the present invention. As is seen from the drawing as the quantity of the individual wipes is withdrawn and separated from the roll of wipes initially provided (and as depicted in FIG. 15) removal of the wipes causes the radius of the central hole 95 to increase several times over its original radius as illustrated in FIG. 15. The wipes are unrolled (or alternately, unspooled) from the interior of the roll 90 and here are shown being unrolled in a clockwise direction, but it is to be understood that the wipes may also be unrolled in a counter-clockwise manner as well. Consequently, unrolling of an individual wipe 91 from the interior of the roll 90 causes the orientation of the wipe being removed from the interior of the roll 90 to now vary in its radial direction with respect to the dispensing orifice 30 when a wipe 91 is withdrawn outwardly from the roll 90. With the ever-increasing radius of the central hole 95 which increases with the removal of successive wipes 91 from the roll 90, both the direction, and the angle of the individual wipe 91 being withdrawn from the roll 90, with respect to a non-concentrically located dispensing orifice 30 varies to a somewhat unpredictable extent. This variation is most pronounced when the roll of wipes 90 is substantially exhausted as while the inner radius IR of the central hole 95 has increases substantially from its initial dimension, the outer radius R1 of the roll of wipe 90 has remained substantially the same. Additionally the radial direction of the individual wipe 91 with respect to the dispensing orifice 30 varies as well. Such changes are in part manifested in part by a varied "entry angle" (and/or "EA"; see FIGS. 20A, 20B) which may be defined to be the angle formed by an individual wipe 91 being pulled outwardly from a roll 90 and towards or through the dispensing orifice 30 as measured from the end of the roll 92 with respect to the common axis CA. Such changes are also in part manifested by a varied "exit distance" (and/or "ED"; see FIGS. 20A, 20B)) which may be defined to be the distance formed by an individual wipe being pulled outwardly from a roll 90 as measured from the end 92 of the roll 90, and to the dispensing orifice 30. The change in radial direction may also be defined as the change in the radial degrees of an individual wipe 91 being pulled outwardly from a roll 90 and through the dispensing orifice 30 as measured from the interior of the roll 90 from which the individual wipe 91 is withdrawn; it is to be appreciated that during withdrawal of an individual wipe 91 the change in radial direction may vary widely depending upon the remaining number of individual wipes 91 remaining on a roll of wipes 90.

FIG. 17 illustrates a detailed view of a first embodiment of a dispensing orifice 30 with a plurality of surrounding lobes 31. In this embodiment, there are provided four individual lobes 31, which are separated from each other by intermediate gaps 33. As is visible from the figure, two of the lobes are present and provided as part of the hinged plate part 15, while the remaining two lobes are provided as, and form part of the plate 4. In the embodiment shown, the arrangement of the lobes 31 and the intermediate gaps 33 are generally circular, and fall within the circle defined by dotted line 30. Also, it is to be understood that the arrangement of the lobes 31 and gaps 33 are concentric about the center axis CO, although such is not required in each embodiment such is nonetheless a preferred embodiment. Each of the lobes 31 depends from either the hinged plate part 15 or from the plate 4, and when these two plates are essentially coplanar when these parts are in a "closed position", they cooperatively form the dispensing orifice 30. Each of the lobes 31 includes a base part 34 from which extends a lobe arm 31A which comprises a major part of the length of each lobe, and therefrom extends a lobe hook 31B which terminates at a lobe tip 35. The lobe hook 31B is angled with respect to the lobe arm 31A, and in preferred embodiments, the direction of the angled lobe hook 31B is inwardly and downwardly from the plate 4 in the direction of the container 60. In certain embodiments, such as those illustrated in FIGS. 17 and 18, the overall length of each of the individual lobes 31 is generally equal to one another, and further, in preferred embodiments the overall dimensions, including length, width, as well as thickness, of each of the individual lobes is also symmetrical with respect to each other. Similarly, according to further embodiments the overall dimensions of the gaps 33 between each of the lobes 31 is also similar to each other present in a dispensing orifice 30. Preferably, the ratio of the length of the lobe arm to the lobe hook is about 2:1, preferably 10-2.2:1, and more preferably 10-5:1. Furthermore, the preferred that the angle of the lobe hook 31B is between 5-45 degrees of arc, preferably between 5-30 degrees of arc when measure with respect to the lobe arm 31A.

FIG. 18 illustrates a detailed view of a further embodiment of a dispensing orifice with a plurality of surrounding lobes, similar in most respects to that of FIG. 17. The embodiment of FIG. 18 differs from that from the embodiment of FIG. 18 in the number of, placement of the individual lobes 31 and the gaps 33.

FIG. 19 illustrates a detailed view of an alternate embodiment of a dispensing orifice 30 with a plurality of surrounding lobes 31, wherein the overall configuration of the dispensing orifice 30 is noncircular. Nonetheless, as can be seen from FIG. 19, part of the surrounding lobes 31 depend from and form part of the hinged plate 15, whereas remaining lobes 31 depend from and form part of the plate 4.

Preferably the lobes 31 of the dispensing cap 1, and particularly advantageously, all parts of the dispensing cap are formed from a material which is flexible. Coming into consideration are metals and fibrous materials but particularly useful are polymeric materials which are synthetic polymers or copolymers, or which may be obtained from naturally derived polymers. The use of synthetic polymers and copolymers expressly include but not limited to one or more of: polyamides (e.g., Nylon), polyolefins (e.g., polypropylene, polyethylene), polyalkyleneterephalates (i.e., polyethylene terephthalate, polybutylene terephthalate), polystyrenes, polysulfones, polycarbonates as well as copolymers formed from monomers of one or more of the foregoing. Polyolefins such as polyethylene in various grades, such as LLDPE, HDPE, PE are preferred. The use of one or more synthetic polymers in the construction of the dispensing cap 1 provides several concurrent advantages. Such materials are easily molded, they are durable, and may include some degree of flexibility which is imparted to the ultimate molded article. Additionally the use of such synthetic polymers also provides for the provision of a "living hinge" as hinge 17 squadron, as well as the hinge element 11, when a cap 10 is included as part of the dispensing cap 1.

The operating principles of the invention are more clearly understood with reference to the remaining figures.

FIG. 20A depicts in an elevational view, a cross-section of dispensing cap according to FIG. 1 mounted upon an upper part of a container 60 further illustrating a plurality of individual wipes in the form of a continuous roll of wipes 90 within the dispensing container 100 with one of the wipes 91 being partially withdrawn from the roll 90 and part of said wipe 91 been retained by the surrounding lobes 31 of the dispensing orifice 30. According to the depicted arrangement of the roll of wipes 90, and the individual wipe 91 being drawn outwardly from the interior of the roll 90 and the relative position of the dispensing orifice 30 depicts one "state" or "arrangement" of these elements, here wherein the "entry angle" here "EA-1" is the angle formed by an individual wipe 91 being pulled outwardly from a roll 90 toward the dispensing orifice 30 as measured from the end of the roll 92 with respect to the common axis CA. An "exit distance" here "ED" is the distance formed by an individual wipe being pulled outwardly from a roll 90, and through the dispensing orifice 30 as measured from the end of the roll 92 to the dispensing orifice 30. These values differ from these same values as compared to the "state" or "arrangement" of these same elements when in the relative positions depicted on FIG. 20B. As will be appreciated by skilled artisans, the individual wipes being withdrawn from the dispensing container according to the present invention inherently and necessarily undergo much greater variations and steeper entry angles, "EA", due to the offset placement of the exit orifice 30 provided and the differing radial orientations of individual wipes 91 being spooled from the roll of wipes 90, as the roll of wipes often generally static with respect to the container 60 when an individual wipe 91 is being withdrawn. Such a problem could be ameliorated, by the adoption of a centrally positioned exit orifice, such as has been suggested by U.S. Pat. No. 7,216,775, however this prior art design also limits the possible configurations for the swing portions which are necessary in order to allow for a user to pull out a wipe from the interior of its container. This limitation however is impractical in certain circumstances. The design suggested by U.S. Pat. No. 7,216,775 also never addressed the problem of providing consistent payout, or of providing a relatively uniform tension required to separate a wipe to be dispensed from a roll of wipes in a container wherein the dispensing orifice is offset from the central axis of the dispensing cap. Mere repositioning of this central orifice according to the design suggested by U.S. Pat. No. 7,216,775 at an offset from a central axis by itself would not provide for relatively uniform tension required to separate a wipe to be dispensed from a roll of wipes in a container, as no feature of such offset dispensing orifice of U.S. Pat. No. 7,216,775 addresses or overcomes the constantly changing variations in tension required to separate a wipe, roll of wipes when the entry angle and exit distance vary to a great extent, particularly as the supply of wipes is being exhausted from the roll of wipes.

Surprisingly, the present inventors of overcome this shortcoming in the prior art by including in their dispensing cap 1 the brace wall 50 which extends downwardly from the underside 19 hinged plate part 15, or namely, in a direction inwardly towards the container 60, which brace wall 50 is located at or near the periphery of the portion of the dispensing orifice 30 present on the hinged plate part 15, as has been previously described as well as being depicted in FIGS. 20A and 20B. The addition of the brace wall 50 provides two functions which substantially improve the performance of dispensing notwithstanding the constantly changing variations in tension required to separate a wipe 91 from a roll of wipes 90 when the entry angle "EA" and exit distance "ED" defined by a wipe 91 being dispensed varies to a great extent, particularly as the supply of wipes is being exhausted from the roll of wipes. First, the brace wall 50 provides a stiffening effect to the proximate portions of the hinged plate part 15 and particularly, to the individual lobes 31 which are proximate to the brace wall 50. Secondly, and perhaps more significantly, the placement of the brace wall 50 and its downward direction into the interior of the container and towards the roll of wipes 90 provides for a physical barrier element whereby a first direction or exit angle, viz. EA, of an individual wipe being withdrawn can be redirected or deflected into a second, shallower, more vertical exit angle, relative to the common axis CA. This is illustrated on FIG. 20B, wherein the wipe 91 being withdrawn from the roll of wipes 90 initially assumes a first exit angle "EA-2" between the end 92 of the roll of wipes 90 and the top 59 of the brace wall 50. More simply put, the edge of the individual wipe 91 being withdrawn from the roll 90 assumes a first, steeper exit angle EA-2 passing the top 59 of the brace wall 50 and then bends around it, viz., is diverted, to a second, shallower exit angle "EA-3" as measured from the top 59 to the dispensing orifice 30 relative to the common axis CA. This modification of and reduction in the exit angle EA due to this interaction with the brace wall 50 is not insignificant and such surprisingly improves the performance characteristics of the dispensing cap 1 as it imparts the requirement of a more consistent tension need to separate a wipe 91 from a next wipe on a roll 90 of wipes. Such is not attained when a brace wall 50 is omitted and the dispensing orifice 30 is merely offset from the common axis CA or central axis of the dispensing cap 1.

A further advantage of dispensing caps 1 according to the preferred embodiment illustrated is that, due to the combination of the offset dispensing orifice 30 as well as the distance from the forward edge 18 to the hinge 17, such allows for the provision of a generally larger plate opening 22 without requiring an increase in the distance between the forward edge 18 to the top 92 of the roll of wipes 90 positioned in the container 60, as is necessitated by the prior art design of FIG. P1.

The benefits of the inventive dispensing cap are discussed in more detail with respect to FIGS. 21A and 21B. FIG. 21A depicts a cross-sectional view, in more detail, a portion of a dispensing cap 1 illustrating the manner in which an individual wipe 91 is withdrawn through the dispensing orifice 30, which figure corresponds to the relative position of the continuous roll 90 of wipes, and the individual wipe 91 being withdrawn relative to the dispensing orifice 30 and the dispensing cap 1 as depicted on FIG. 20A. As is more clearly seen in this figure, the direction of the wipe 91 extending along the exit angle "EA-1" being withdrawn via the exit orifice 30 does not cross or intersect any part of the brace wall 50, the individual wipe 91 does not come in contact therewith. The flexible individual lobes 31 are however flexed upwardly and outwardly from the plate 4 and hinged plate part 15 and physically grip and drag against the wipe 91. This physical interaction causes the flexible individual lobes 31 to flex from their unstressed positions, as illustrated in earlier figures, e.g., as per FIGS. 1-6. Such physical interaction also imparts a degree of surface drag upon the wipe 91, and as the wipe is withdrawn and the perforation separating it from the next adjacent wipe on the roll of wipe 90 passes outwardly from the dispensing orifice 30. The individual wipe 91 is separated and torn away from the remaining wipes. At the same time, the leading edge of the next wipe from the roll of wipes 90 present within the dispensing orifice 30 is retained thereby interacting with the flexible individual lobes 31 which retained it in that position. It is to be noted that in this mode of dispensing, the relatively shallow angle of the exit angle EA-1 typically results in a uniform degree of flexure of each of the individual lobes, irregardless of whether they depend from the plate 4 or from the hinged plate part 15.

FIG. 21B depicts a cross-sectional view, in more detail, a portion of the dispensing cap 1 illustrating the manner in which an individual wipe 91 is withdrawn through the dispensing orifice 30. This figure corresponds to the relative position of the continuous roll 90 of wipes and the individual wipe 91 being withdrawn relative to the dispensing orifice 30 and the dispensing cap is depicted on FIG. 20B. As is understood from that figure, the direction of a first exit angle "EA-2" is much more inclined with respect to the common axis CA. Additionally, as part of the individual wipe 91 being withdrawn from the roll of wipes 90 comes in contact with the top 59 of the brace wall 50 such reorients the wipe passing over the top 59, imparting a second, further and shallower exit angle "EA-3" as is depicted. The shallower angle "EA-3" measured with respect to the common axis CA is less than the exit angle "EA-2", and this shallower angle EA-3 provides for a more consistent consumer experience, by requiring a more consistent tension to withdraw and separate an individual wipe 91 than had the brace wall 50 been absent. Tension supplied by user pulling on an individual wipe 91 is needed to separate the wipe 91 being withdrawn from the dispensing cap 1 at a point within the top cavity 5 at a point exterior of the dispensing cap 1. The presence of the brace wall 50 aids in providing a more consistent tension in order to withdraw and separate and individual wipe 91 as, irregardless of the positioning of the continuous roll 90 of wipes relative to the orifice 30, as the presence of the brace wall 50 insures that the individual wipe 91 is in contact therewith as it is pulled from the roll 90. The wipe's 91 contact with the top 59 of the brace wall 50 provides a degree of drag against an edge (top 59) which also imparts a generally uniform or consistent tension between the top 59 and the lobes 31 of the dispensing orifice, to a level greater than would have been present had the wipe 91 not intersected or been traversed by the brace wall 50. Alternately stated, the presence of the brace wall 50 operates to reorient or re-angle the angle EA-2 which may vary depending upon the orientation of the individual wipe 91 being unspooled from the roll of wipes 90 as well as the relative orientation of the roll of wipes 90 with respect to the cap 1 and the orifice 30, to the consistent and shallower angle EA-3 between the edge (top 59) and the orifice 30, and especially the center part thereof. Such provides a more consistent consumer experience. Additionally the redirection of the wipe 91 from the steeper direction along the line of EA-2 to the shallower direction of the wipe 91 along the line EA-3, both being measured relative to common axis CA, also provides a more consistent consumer experience. Advantageously the brace wall 50 is of a configuration as depicted on FIGS. 3 and 6, and the brace wall 50 is at an oblique angle with respect to the hinged plate part 15, and the brace wall 50 includes a center region 52 from the ends of which extend outwardly tapering support walls 54, 56 which also depend from the forward edge 18 of the hinged plate part 15, as well as a top 59.

Additionally as is noted by the illustration of FIG. 21B, the direction of the individual wipe 91 as it is being withdrawn through the dispensing orifice 30 also influences the ultimate position of the individual lobes 31 as the individual wipe 91 is being withdrawn separated. Namely, as is seen in FIG. 21B, the individual lobes which depend from the hinged plate part 15, and whichever bases 34 are adjacent or are proximate to the brace wall are caused to be less flexible than the individual lobes 31 which depend from the plate 4. This imparts a varied degree of tension on the individual wipe 91 and facilitates its withdrawal and separation from the next wipe.

FIG. 22 depicts in a cross-sectional view, a portion of a dispensing cap according to the present invention illustrating the manner in which an individual wipe 91 may be initially withdrawn through the plate opening 22. As is visible there from, the hinged plate part 15 is swung inwardly about the hinge 17 thereby providing access for a a part of a consumer's hand 110 to grasp an individual wipe 91 from within the interior of the roll 90 and withdraw it outwardly from the dispensing cap 1.

FIG. 23 depicts in a cross-sectional view, a portion of a dispensing cap according to the present invention illustrating the manner in which an individual wipe 91 can be withdrawn through the plate opening 22. As depicted, the wipe 91 may engage the individual lobes 31 and/or the brace wall 50, which due to the tension present within the wipe caused by pulling the individual wipe 91 by the consumer 110, causes the hinged plate part 15 to rotate upwardly around the hinge 17 in the direction such that the hinge plate part 15 will span and close the plate opening 22.

As can be appreciated from the preferred embodiments illustrated, according to preferred embodiments when the hinged plate part 15 is in a "closed position", it is essentially coplanar with the stationary plate 22 and essentially all of the plate opening 22 is spanned by and closed by the hinged plate part 15, except for the intermediate gaps 33 present within the dispensing orifice 30, and any gaps which may be present between the margins of the hinged plate part 15 and the stationary plate 4. Said gaps may be reduced or eliminated however by providing elements with closer fitting features, or by overlapping parts of the hinged plate part 15 with parts of the stationary plate 4. Such a configuration thus leaves only a very limited area of available passage across the plate 4 when the dispensing cap 1 is in a closed position, which available area is further diminished by part of a wipe 91 which is held in place by the lobes 31 and retained in said position between dispensing operations. Thus, even if a cap 10 or overcap is omitted, the likelihood of premature drying out of, such as by evaporation, of any liquid used to impregnate one or more of the wipes within the container 60.

While described in terms of the presently preferred embodiments, it is to be understood that the present disclosure is to be interpreted as by way of illustration, and not by way of limitation, and that various modifications and alterations apparent to one skilled in the art may be made without departing from the scope and spirit of the present invention.

The invention claimed is:

1. A dispensing cap adapted to be removably, or permanently affixed to a container which container contains a plurality of individual wipes interconnected to one another but separable along one or more perforations between individual wipes, which dispensing cap includes a stationary plate part and a moveable plate part and having a dispensing orifice which is offset from the center part of the dispensing cap wherein a portion of the dispensing orifice is defined by and is integral to the stationary plate part and the remaining portion of the dispensing orifice is defined by and is integral to the moveable plate part, said dispensing orifice being surrounded by a plurality of individual flexible lobes, the moveable plate part being hinged and moveable along a hinge line from which the moveable plate part depends from a part of the stationary plate, and further wherein the moveable plate part includes a depending brace wall which extends downwardly from the moveable plate part from the underside thereof, which brace wall is located at or near the periphery of the said remaining portion of the dispensing orifice present on the moveable plate part, and which brace wall is angled at an oblique angle with respect to the hinged plate part.

2. A dispensing cap according to claim 1, which dispensing cap further includes a top closure cap.

3. A dispensing cap according to claim 1, wherein the brace wall 50 is angled with respect to the hinged plate part.

4. A dispensing cap according to claim 1, wherein the brace wall is angled at an oblique angle in the range of from about 25-60, degrees of arc with respect to the hinged plate part.

5. A dispensing container comprising:

a dispensing cap according to claim 1, a container, and a plurality of individual wipes provided as a continuous linear roll of preimpregnated wipes separable from one another along one or more perforations present between individual wipes.

6. A dispensing cap according to claim 1, wherein the lobes individually have bases, and wherein the lobes depending from the moveable plate part are less flexible than the lobes which depend from the stationary plate part.

* * * * *